United States Patent [19]

Iodice

[11] 4,182,213

[45] Jan. 8, 1980

[54] COIL LESS MAGNETIC PICKUP FOR STRINGENT INSTRUMENT

[76] Inventor: Robert M. Iodice, 6540 Kirkville Rd., East Syracuse, N.Y. 13057

[21] Appl. No.: 902,272

[22] Filed: May 3, 1978

[51] Int. Cl.[2] ..... G10H 3/08

[52] U.S. Cl. ..... 84/1.15; 84/1.16

[58] Field of Search ..... 84/1.1, 1.14, 1.15, 84/1.16, DIG. 7; 338/32 R, 32 H, 69; 330/6

[56] References Cited

U.S. PATENT DOCUMENTS

| | | | |
|---|---|---|---|
| 3,082,507 | 3/1963 | Kuhrt | 330/6 |
| 3,195,043 | 7/1965 | Burig | 338/32 H |
| 3,297,813 | 1/1967 | Cookerly | 84/1.15 |
| 3,325,579 | 6/1967 | Cookerly | 84/1.15 |
| 3,590,134 | 6/1971 | Ogi | 338/32 R |
| 3,617,600 | 11/1971 | Ohno | 84/1.1 |

*Primary Examiner*—Gene Z. Robinson

*Assistant Examiner*—William L. Feeney

*Attorney, Agent, or Firm*—Charles S. McGuire

[57] ABSTRACT

A magnetic pickup for an electronic amplification system of a stringed musical instrument wherein the variable electrical signal produced in response to the string traversing the lines of flux from a permanent magnet is generated by a Hall effect sensor, thereby eliminating the usual inductively coupled coil(s). The invention is disclosed in embodiments employing bar and horseshoe magnets with the sensor positioned on the opposite or on the same side of the magnet as the string. The sensor is an essentially planar device which may be positioned in a plane substantially normal to the lines of flux in contact with or spaced a predetermined distance from the associated magnet or positioned in a plane non-perpendicular to the lines of flux, or adjustably positioned with respect to the direction of flux lines to achieve the desired degree of sensitivity.

10 Claims, 4 Drawing Figures

COIL LESS MAGNETIC PICKUP FOR STRINGED INSTRUMENT

BACKGROUND OF THE INVENTION

The present invention relates to magnetic pickups for stringed musical instruments and, more particularly, to a variable reluctance pickup system which requires no inductively coupled coils.

Many stringed musical instruments, most notably guitars, are presently provided with electronic amplification systems which employ mechanical-electrical transducers. These transducers, or pickups, include one or more permanent magnets fixedly or adjustably positioned with respect to the magnetically permeable strings so that the lines of magnetic flux are traversed by the vibrating string. A voltage is induced in a coil surrounding one or more magnets or pole pieces in accordance with the magnetic reluctance as determined by the frequency and amplitude of string vibration. Although many variations of magnet-coil configurations and couplings have been suggested in the prior art in order to improve or modify the sound output in some desired manner, it remains a costly and difficult operation to wrap the coils which are inductively coupled to the magnets.

It is a principal object of the present invention to provide a magnetic pickup in combination with a stringed instrument with improved sound reproducing qualities.

A further object is to provide a stringed instrument magnetic pickup having no inductively coupled coils, thus essesntially eliminating hum pick-up.

Another object is to provide a magnetic pickup which is more compact than conventional magnet-coil pickups while providing as good or better quality of sound reproduction.

A still further object is to provide a novel and improved electronic pickup for a stringed instrument having better frequency response, signal-to-noise ratio, and hum and noise rejection than conventional, inductive coil pickups.

Still another object is to provide a magnetic pickup for stringed instruments which is both reliable and relatively inexpensive to manufacture.

Other objects will in part be obvious and will in part appear hereinafter.

SUMMARY OF THE INVENTION

In accordance with the foregoing objects, the invention comprises a pickup system having a permanent magnet positioned for traversal by a vibrating string of the lines of magnetic flux emanating therefrom. A solid state device known as a Hall effect sensor or cell is positioned to intersect the lines of magnetic flux so that cell output is responsive to variations in reluctance produced by movement of the string through the magnetic field. The Hall cell is connected to an operational amplifier, the cell and amplifier preferably forming an integrated circuit having an output connected to drive a suitable speaker system. A separate magnet, or separate pole pieces, and Hall cell are provided for separately sensing and responsing to the vibrations of each string of the associated instrument. The invention is described in embodiments employing both bar and horseshoe type magnets.

DETAILED DESCRIPTION

Figure 1:
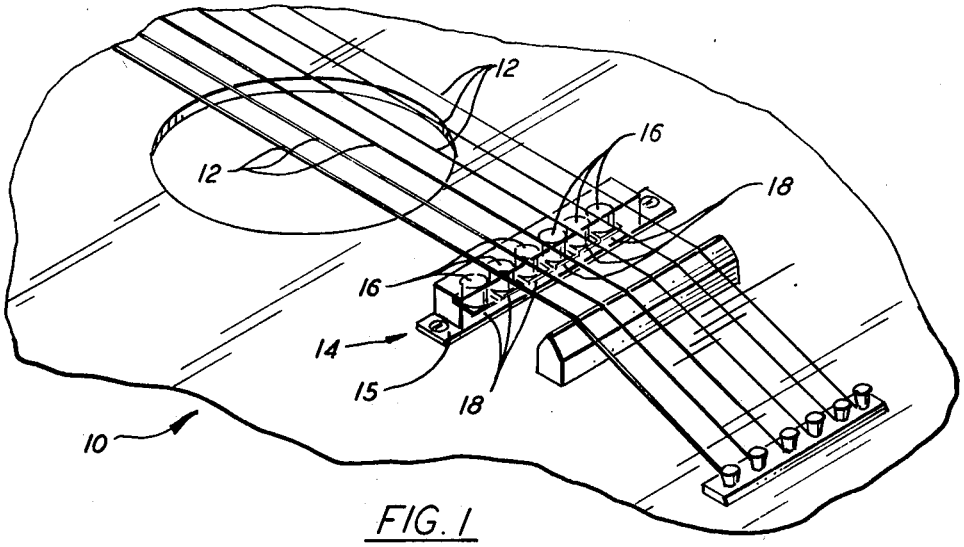
FIG. 1 is a fragmentary, perspective view of a portion of a stringed instrument incorporating the pickup of the invention.

Referring now to the drawing, in FIG. 1 is shown a fragment of a stringed musical instrument, generally denoted by reference numberal 10, having a plurality of tensioned strings 12. The pickup device 14 of the invention is designed to sense the vibrations of strings 12 and to produce an electrical signal commensurate therewith for driving the speaker(s) of a sound system to reproduce, sometimes in modified form, the sound waves generated by the string vibrations.

Pickup 14 includes a suitable support frame 15, fixedly attached to instrument 10 and holding a plurality of permanent magnets 16. Each of magnets 16 is positioned for traversal of the lines of magnetic flux emanating therefrom by one of strings 12 as the latter vibrates in the common plane of the strings. Also supported on frame 15 are solid state devices known as Hall effect sensors or cells 18. These are essentially planar devices fabricated from silicon and are commercially available, for example, from Microswitch, a division of Honeywell, Inc., Rochester, N.Y. One of cells 18 is positioned adjacent each of magnets 16 in a plane intersecting the lines of magnetic flux associated therewith.

Figure 2:
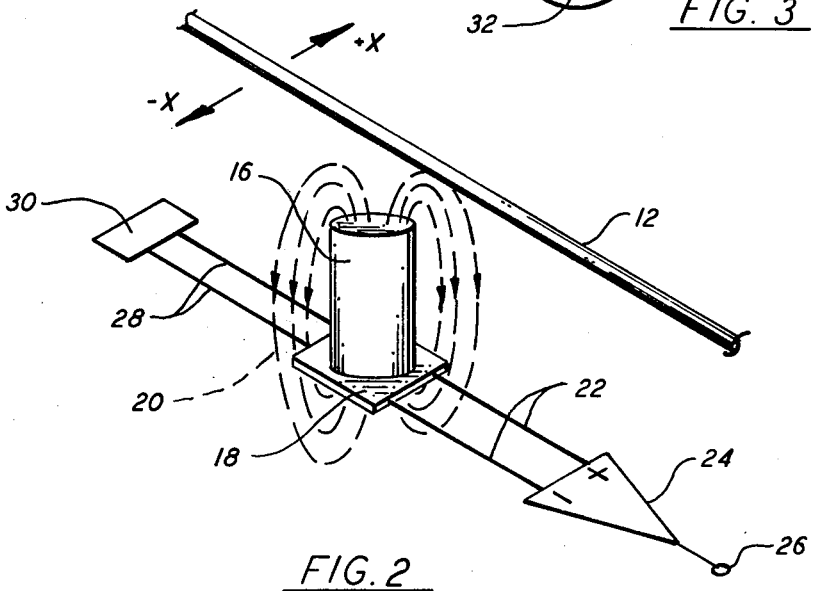
FIG. 2 is an enlarged, perspective view of a single string and associated pickup elements of the instrument of FIG. 1.

A fragment of one of strings 12 is shown in FIG. 2 with the associated magnet 16 and Hall cell 18. In this embodiment, magnet 16 is the form of a cylindrical bar magnet having north and south poles at opposite ends, the lines of magnetic flux being indicated by the lines denoted generally by reference numeral 20. Cell 18 is in the form of a thin, flat wafer positioned in a plane normal to the axis of magnet 16 intersecting the lines of magnetic flux. Cell 18 is connected by leads 22 to operational amplifier 24 having output 26, and by leads 28 to an appropriate power supply, indicated by box 30. Preferably, cell 18 and amplifier 24 are formed as an integrated circuit in a single chip having a power requirement on the order of 15 milliwatts. The operating characteristics of the Hall cell are such that the electrical output signal is a function of the reluctance of the magnetic field intersected thereby. Thus, variations in reluctance produced by vibration of string 12 generally in the direction of arrows $-x$ and $+x$ (although properly specking, the strings will tend to vibrate in an elliptical space) are reproduced in the electrical signal at output 26 which is used to drive a conventional loudspeaker (not shown) to provide electronic amplification of the sound produced by the vibrating string.

Figure 3A:
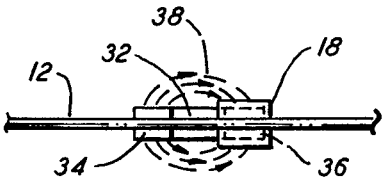
FIGS. 3 and 3A are side elevational and plan views respectively, showing an alternate embodiment of the pickup elements.
Figure 3:
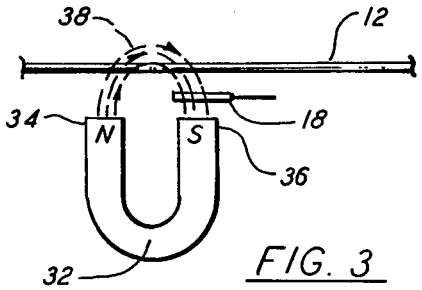

A second embodiment of the invention is illustrated in FIG. 3. Horseshoe magnet 32, having north and south poles at adjacent ends 34 and 36 is held by appropriate support means for traversal of flux lines 38 by string 12. Hall cell 18, connected as before to a power supply and operational amplifier, is positioned between string 12 and one of the poles of magnet 32 in a plane intersecting flux lines 38. Possibilities for improved pick-up are enhanced by use of the horseshoe magnet since the field between the two pole pieces is elongaged and oriented along the axis of the string, as best seen in FIG. 3A. Thus, there is better isolation of the pick-up of the vibration of a single, individual string by the magnet and sensor associated therewith. Although it is more difficult to provide a coil winding in association with a horseshoe magnet, the pick-up of the present invention may be employed with equal facility with all types of magnets. It should also be noted that a single magnet with multiple pole pieces may be used and the Hall effect sensor is positioned to intersect the lines of flux from a pole piece, whether such piece constitutes part of the magnet itself or a separate pole piece.

For proper function, the properties of the magnet and cell, and positions thereof relative to one another and to the associated string, must be in proper relation. For maximum sensitivity the cell should be oriented in a plane normal to the lines of flux intersected thereby. Sensitivity adjustment may be provided, if desired, by supporting the cells either collectively or individually for adjustment of the cell plane relative to the flux lines, and/or the distance between the cell and magnet pole piece. Also, depending on the strength of the magnetic field, if the cell is too close to the magnet the field may overdrive the cell and its associated amplifier, making it impossible for the cell to detect variations in reluctance of the field. Likewise, if the cell is too far from the magnet, the field may be too weak to appreciably affect the cell's output.

The disclosed system provides a reliable yet inexpensive pickup for ferrous string instruments by eliminating the inductively coupled coils present in prior systems. Since the absence of coils eliminates interwinding capacitance the disclosed pick-up system is capable of much better frequency response characteristics. Also, since the Hall cell is an extremely low output impedance device, the disclosed system is very low in noise pick-up and having no inductance, is relatively insensitive to hum such as 60 cycle power lines.

What is claimed is:

1. A stringed musical instrument having a magnetic pickup comprising:

(a) at least one ferrous string arranged for vibration in a predetermined space;

(b) a permanent magnet mounted in spaced relation to said string such that the lines of magnetic flux emanating from said magnet intersect said space;

(c) a Hall effect sensor arranged with respect to said magnet so as to be permeated by said lines of magnetic flux and to have an electrical output responsive thereto; and (d) electrical amplification means responsive to said sensor output.

2. The invention according to claim 1 and further including a plurality of tensioned strings, permanent magnet means having independent pole pieces mounted with respect to each of said strings such that the lines of magnetic flux emanating from said pole pieces intersect the space of vibration of an associated string, and a Hall effect sensor arranged with respect to each of said pole pieces so as to be permeated by the lines of magnetic flux substantially only of the associated pole piece and to have an output responsive thereto.

3. The invention according to claim 2 wherein said strings are all arranged in a common plane and each magnet pole piece is spaced by a uniform distance from said common plane.

4. The invention according to claim 1 wherein said Hall effect sensor is essentially planar and arranged in a plane substantially parallel to said common plane.

5. The invention according to claim 1 wherein said magnet is a bar magnet having north and south poles at opposite ends, the lines of magnetic flux from one end being traversed by said string during vibration thereof.

6. The invention according to claim 5 wherein said Hall effect sensor is arranged for permeation by the lines of magnetic flux at the opposite end of said magnet.

7. The invention according to claim 6 wherein said Hall effect sensor is spaced by a predetermined distance from said opposite end of said magnet.

8. The invention according to claim 1 wherein said magnet is a horseshoe magnet having north and south poles at adjacent ends and so arranged that the lines of magnetic flux at both ends are traversed by said string during vibration thereof.

9. The invention according to claim 8 wherein said Hall effect sensor is arranged between said string and one of said ends of said magnet.

10. The invention according to claim 1 wherein said Hall effect sensor is spaced from each of said string and said magnet.

* * * * *